US006826375B2

(12) United States Patent
Kitajima

(10) Patent No.: US 6,826,375 B2
(45) Date of Patent: Nov. 30, 2004

(54) IMAGE FORMING APPARATUS

(75) Inventor: Ken-ichiro Kitajima, Toride (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/198,112

(22) Filed: Jul. 19, 2002

(65) Prior Publication Data

US 2003/0016961 A1 Jan. 23, 2003

(30) Foreign Application Priority Data

Jul. 23, 2001 (JP) ..... 2001-221140

(51) Int. Cl.[7] ..... G03G 15/02; G03G 21/14
(52) U.S. Cl. ..... 399/50; 399/76
(58) Field of Search ..... 399/46, 48, 50, 399/51, 52, 53, 76, 128, 168, 170, 174; 361/212, 214, 225

(56) References Cited

U.S. PATENT DOCUMENTS 4,621,920 A * 11/1986 Takahashi ..... 399/128
5,164,771 A * 11/1992 Suzuki et al. ..... 399/46
5,552,865 A * 9/1996 Osawa et al. ..... 399/168
5,659,841 A * 8/1997 Umeda et al. ..... 399/53
5,771,422 A * 6/1998 Morihara ..... 399/50
5,873,019 A * 2/1999 Mizuishi ..... 361/225
6,311,027 B1 * 10/2001 Sakita et al. ..... 399/50
6,560,419 B2 * 5/2003 Sugiura ..... 399/50
2002/0021912 A1 * 2/2002 Tanaka et al. ..... 399/46
2002/0037174 A1 * 3/2002 Fujita ..... 399/53

FOREIGN PATENT DOCUMENTS

JP 01291269 A * 11/1989 ..... G03G/15/02
JP 10-123802 5/1998
JP 11-190922 7/1999
JP 2000147967 A * 5/2000 ..... G03G/15/02

* cited by examiner

*Primary Examiner*—Sandra Brase
(74) *Attorney, Agent, or Firm*—Fitzpatrick, Cella, Harper & Scinto

(57) ABSTRACT

An image forming apparatus includes a photosensitive member, a charger for electrically charging the photosensitive member at a charging position, an image forming system for forming an image on the photosensitive member charged by the charger, and an optical discharger for electrically discharging the photosensitive member. After a start of rotation of the photosensitive member, the optical discharger operates to discharge the photosensitive member and when a leading edge portion of a portion of the photosensitive member discharged by the optical discharger reaches the charging position the charger starts its charging operation.

8 Claims, 9 Drawing Sheets

E-V CHARACTERISTICS

IMAGE FORMING APPARATUS

FIELD OF THE INVENTION AND RELATED ART

The present invention relates to an image forming apparatus, in particular, a copying machine, a printer, a facsimile machine, or the like, which forms an image with the use of an electrophotographic image forming method.

An electrophotographic process makes it possible to instantly form an image with high quality and durability. Thus, its usage did not remain in the field of a copying machine; it has come to be widely used not only in the field of a copying machine, but also in the fields of various printers and facsimile machines.

In principle, an electrophotographic process comprises two distinctive processes: an actual image formation process, and an initialization process. The actual image formation process comprises: uniform charging of a photoconductive member; formation of an electrostatic latent image through the exposure of the charged photoconductive member to an optical image in accordance with an original; development of the latent image with the use of toner; transferring of the toner image onto recording medium such as a piece of paper (or sometimes intermediary transfer medium); and fixation of the toner image, whereas the initialization process is a process for removing the toner particles and electrical charge remaining on the peripheral surface of the photoconductive member, in order to repeatedly use the photoconductive member. Further, according to some reports, in order to stabilize the potential level of a photoconductive member at an early stage of the charging process, an auxiliary charging device is disposed on the upstream side of the charging device, in terms of the moving direction of the peripheral surface of the photoconductive member, more specifically, between the cleaning means and charging means.

The nucleus of an electrophotographic image forming method is a photoconductive member which uses photoconductive substance. In recent years, a photoconductive member which uses electrically conductive organic substance has been developed. Electrically conductive organic substance has some advantages over electrically conductive inorganic substance; for example, it is environmentally harmless, and easy to form into film.

In an electrophotographic process, a photoconductive member is gradually shaved or scratched due to the friction which occurs during the development, transfer, and/or cleaning. Thus, eventually, the thickness of the charge retaining capacity of the outermost layer (film) of the photoconductive member is reduced, reducing thereby the charge retaining capacity of the photoconductive member to a point at which the image forming apparatus employing this photoconductive member begins to form unsatisfactory images, that is, the images the quality of which does not meet a predetermined requirement; in other words, the photoconductive member reaches the end of its service life, and must be replaced with a new one at this point.

It is true that an organic photoconductive members of the current generation is at a highly advanced level due to the recent developments in the field of a photoconductive member. However, the materials for the charge transfer layer, or the outermost layer, of a photoconductive member are still polycarbonate, vinyl polymer, polyester, and the like, which cannot be said to be sufficiently resistant to shaving for the photoconductive member to be satisfactorily used within an electrophotographic image forming apparatus. Thus, the amount of the portion of the charge transfer layer shaved away by the friction, and the number of scars created in the surface of the charge transfer layer by the friction, relatively quickly increase, shortening the service life of a photoconductive member. In other words, the service life of an organic photoconductive member is relatively short, expiring after outputting approximately 50,000 copies.

In comparison, a photoconductive member, the main constituent of which is non-crystal silicon, and which is commonly called an amorphous photoconductive member, has come into use in recent years. The surface layer of this type of photoconductive member is hard, and therefore, is highly resistant to shaving, affording an amorphous photoconductive member an image output exceeding 50,000. Further, referring to FIG. 9, in terms of the relationship (E-V property) between the amount of the drop in the surface potential level of an amorphous photoconductive member and the amount of exposure light, an organic photoconductive member is nonlinear, whereas an amorphous photoconductive member is virtually linear, which in this case is superior. For this reason, an amorphous photoconductive member is characterized in that the difference in diameter among the discrete dots resulting from the use of an amorphous photoconductive is smaller relative to the difference in latent image contrast. Further, the specific inductive capacity of an organic photoconductive member is 2–3, whereas the specific inductive capacity of the amorphous photoconductive member is approximately 10, which is relatively large. Therefore, a toner image formed by developing an electrostatic latent image formed on an amorphous photoconductive member is superior in the development of the smallest picture elements of an image, which is common knowledge. Thus, an amorphous photoconductive member is widely used in the field of a high speed image forming apparatus capable of forming high quality images.

Also in recent years, in order to obtain images of higher quality, to store or freely edit the inputted image formation data, or the like purposes, digitization of an image formation process has been rapidly progressing. Thus, even in the field of an amorphous photoconductive member, the materials suitable for digitization have been developed, some of them having been already put to practical use.

An amorphous photoconductive member, however, is greater in specific inductive capacity and electrostatic capacity than an organic photoconductive member. Thus, in order to charge an amorphous photoconductive member to a potential level high enough to form a satisfactory image using a corona discharge type charging method, a large amount of current is necessary to trigger electrical discharge to the photoconductive member.

Thus, when a charging method based on electrical discharge is used as a method for charging an amorphous photoconductive drum, a large amount of the byproducts of electrical discharge, for example, ozone, NOx, and the like, is likely to adhere to the peripheral surface of the amorphous photoconductive drum, reducing the electrical resistance of its peripheral surface, which in turn disturbs a latent image formed on the peripheral surface of the amorphous photoconductive drum, in particular in a high temperature/high humidity environment in which the surface resistance reduces. This disturbance of a latent image has a blurring effect, resulting in the formation of a defective image; areas of an image made up of discrete dots become blurred, making the areas look like flowing water.

For the reason given above, an amorphous photoconductive member, which normally is chargeable to the positive polarity, is more desirable as a photoconductive member than an amorphous photoconductive member, which normally is chargeable to the negatively polarity and therefore, produces a larger amount of the byproducts of electrical discharge, such as ozone, than the former.

There are two types of developing methods for developing an electrostatic latent image formed by exposing the peripheral surface of a photoconductive member charged to its natural polarity and a predetermined potential level, to an optical image irradiated in response to electrical signals obtained by processing the image formation data into optional toner reproduction patterns. One is a reversal developing method, in which toner which is the same in polarity as the polarity to which a photoconductive member is charged is used, and the other is a normal developing method, in which a reversal image exposure process is used.

Based on the above described knowledge and problems, we, the inventors of the present invention, decided to wrestle with the task of developing an image forming apparatus which was durable, capable of forming high quality images, smaller in the amount of the byproducts resulting from electrical discharge, and superior in terms of the prevention of the formation of blurred images (images suffering from appearance of flowing water) which were likely to be formed in a high temperature/high humidity (H/H) environment. As for the photoconductive member, because of the above described difference in the byproducts resulting from electrical discharge, we decided to use such an amorphous photoconductive member that is positively chargeable, durable, and capable of bearing a high quality latent image. As for the toner, we decided to use negatively chargeable toner, for which a wider selection of materials are available in terms of charge polarity. As for the exposing method, a background image exposing method (which hereinafter will be referred to as BAE method), that is, an exposing method which exposes the areas of the peripheral surface of a photoconductive member, which correspond to the non-image areas (background areas) of an intended image. As for the charging method, we decided to employ a corona discharge type charging method, which is capable of positively charging an amorphous photoconductive member so that a high quality latent image can be formed and developed, and the amount by which the byproducts generated by electrical discharge, such as ozone, is smaller.

First, in order to improve the controlling method to be used in the image forming apparatus for controlling the process for charging a photoconductive member, we studied the charging process controlling method proposed in Japanese Laid-open Patent Application 11-190922, in which essential control was carried out in the initial stage of a charging process.

More specifically, according to this patent application, in order to erase the hysteresis on a photoconductive drum, the photoconductive drum was exposed by an optical charge removing means immediately after the photoconductive drum begins to be rotated. Then, the charging of the photoconductive drum by a charging means is started. In order to ensure that the potential level of the photoconductive drum converged to a potential level equal to the potential level corresponding to a non-image area, the photoconductive drum was exposed to a proper amount of light for effecting the potential level corresponding to a non-image area (which hereinafter may be referred to as non-image area potential level), by the exposing means, in the early stage of the charging process, for a predetermined length of time which was set with the provision of some margin, in consideration of the fluctuation in the voltage applied to trigger electrical discharge to charge the photoconductive drum, the variation in the startup time of the exposing means, the fluctuation of the rotational speed of the photoconductive drum, the variation in the timing with which voltage is applied to the charging means, and the like factors. As a result, however, the following problems occurred.

(1) During the first rotational cycle of the photoconductive drum, the photoconductive drum was less uniformly charged, by a drastic margin, than during the second rotational cycle of the photoconductive drum and thereafter.

(2) Images suffering from ghosts were produced, the locations of which corresponded to the non-charged regions of the photoconductive drum (the region, which was cleared of electrical charge by the charge removing means, but was not charged by the charging device), and the region of the photoconductive drum, the location of which corresponds to the period in which the photoconductive drum was exposed to the optical image to reduce the potential level of the region of the photoconductive drum to the non-image potential level.

In the case of the BAE method employed by the present invention, a latent image is normally developed, in other words, toner is adhered to the areas of the photoconductive drum 1 with electrical charge (potential level of Vd). Therefore, the deviation in development contrast (difference in potential level between the development voltage and the area of photoconductive drum to which toner is adhered: Vcont) straightforwardly manifests as image density deviation. A ghost potential level, that is, the manifestation of the memory generated in the aforementioned non-charged region as the aforementioned non-charged region is exposed by the exposing means, is lower than a potential level, to which the photoconductive drum is charged by the charging means during the second rotational cycle of the photoconductive drum and thereafter. Therefore, a resultant image suffers from a narrow rectangular negative ghost, which extends in the direction perpendicular to the recording medium conveyance direction.

Further, even when correcting, in order to realize proper latent image contrast, the amount of the exposure light for latent image formation, corrections are made based on the potential level of the non-charged region of the photoconductive drum, which is detected by the potential level detecting means to confirm the accuracy of the potential level, to which the potential level of the photoconductive drum will drop as the photoconductive drum is exposed, in other words, based on the potential level of the region in which an optical memory has already been generated by the excessive amount of charge removing light irradiated by the charge removing means, and also by the exposing means. Therefore, it is impossible to accurately calculate a compensatory amount for realizing the proper potential level VI (potential level resulting from maximum exposure). As a result, defective images were produced.

We also studied a charging method, such as the one disclosed in Japanese Patent Application Publication 10-123802, which employed an auxiliary charging device, as a countermeasure for the above described problem. However, the provision of an auxiliary charging device increases product cost. Also, usage of corona type charging device as an auxiliary charging device increases the ozone concentration. Further, in the case of an electrophotographic image formation method employing an amorphous photoconductive member, the provision of an auxiliary charging device adds to the number of factors which effect defective images, more specifically, partially or totally blurred images giving an appearance of flowing water. Thus, in order to provide an image forming apparatus capable of reliably forming high quality images, a charging method capable of eliminating the above described problems without the provision of an auxiliary charging device has been desired.

SUMMARY OF THE INVENTION

Thus, the primary object of the present invention is to provide an image forming apparatus capable of preventing the occurrence of image defects traceable to nonuniformity in potential level.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS (Embodiments)

Figure 1:
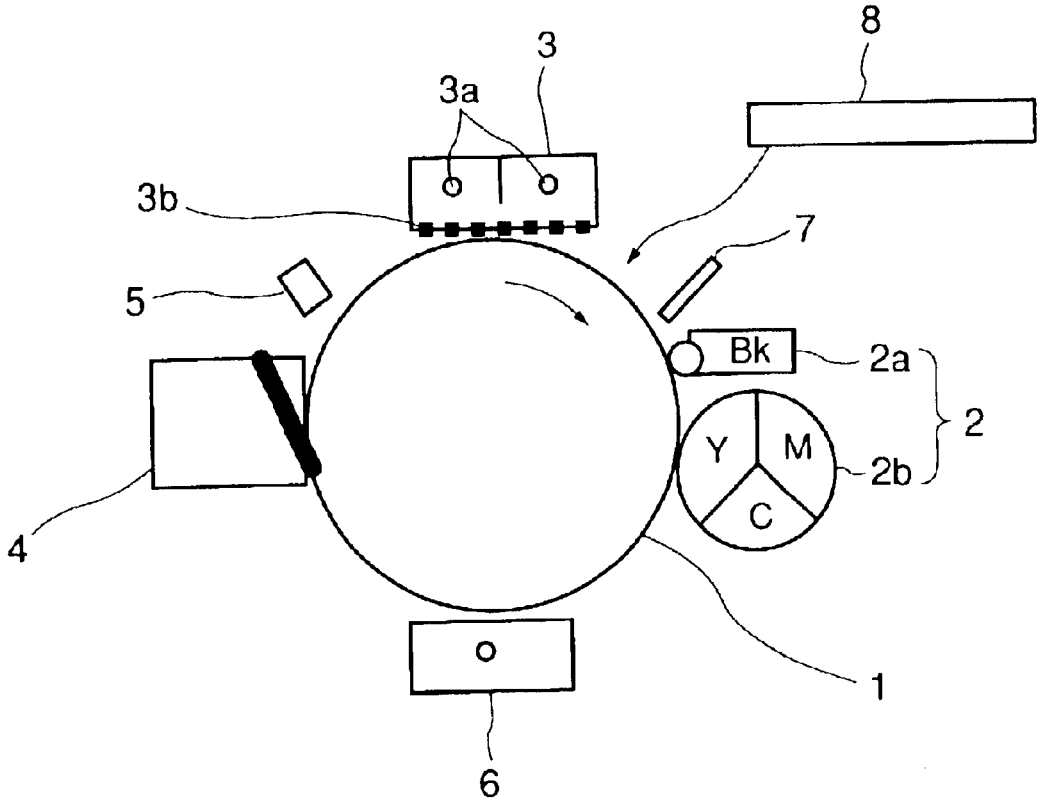
FIG. 1 is a schematic sectional view of an image forming apparatus.
Figure 2:
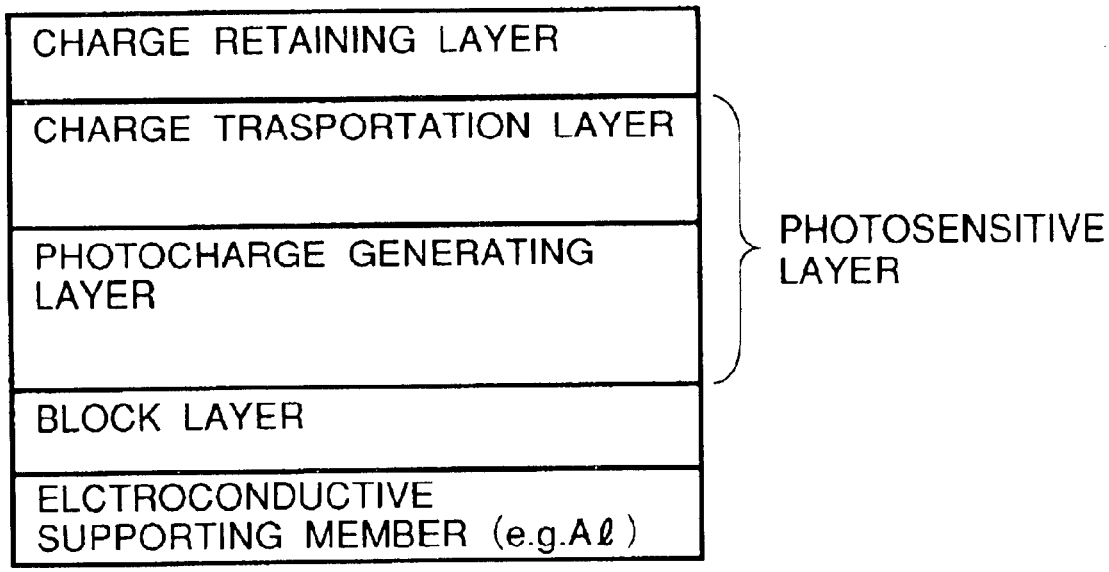
FIG. 2 is a schematic drawing for depicting the structure of a photoconductive drum.
Figure 3:
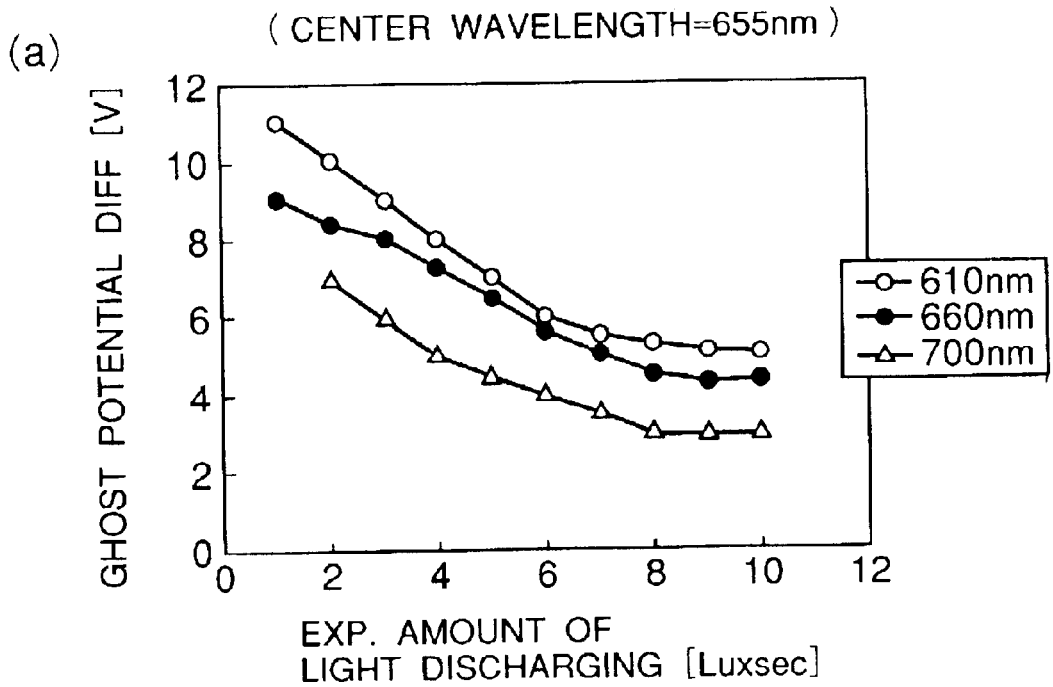
FIG. 3 is a drawing for depicting the ghost potential level.
Figure 3:
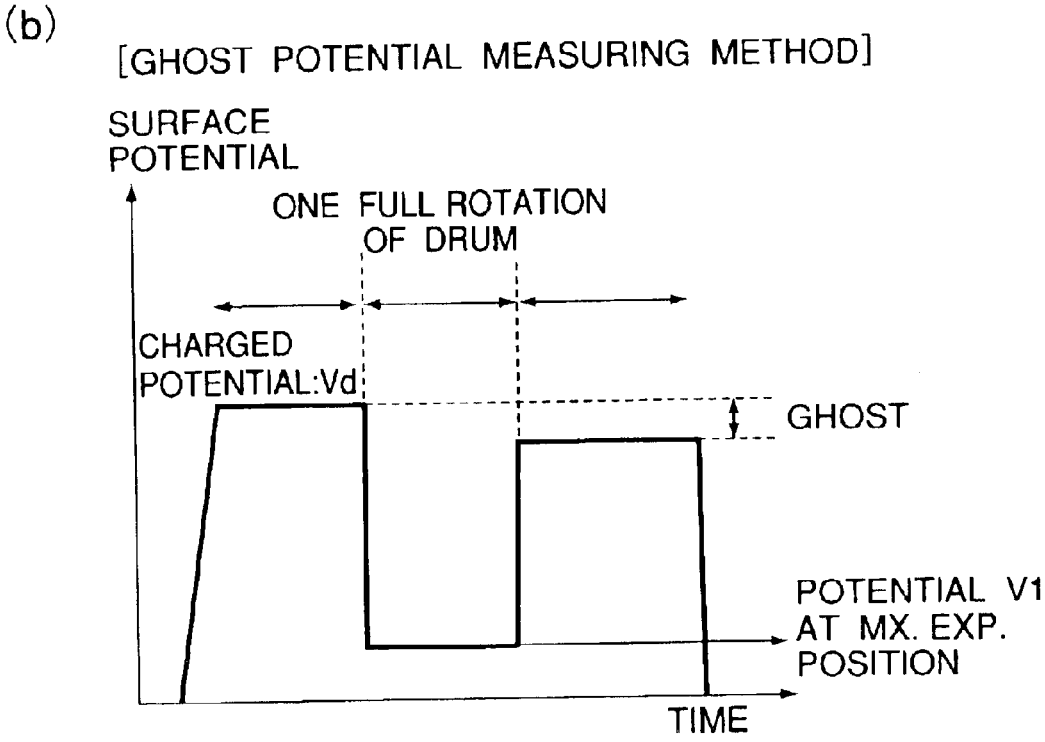
Figure 4:
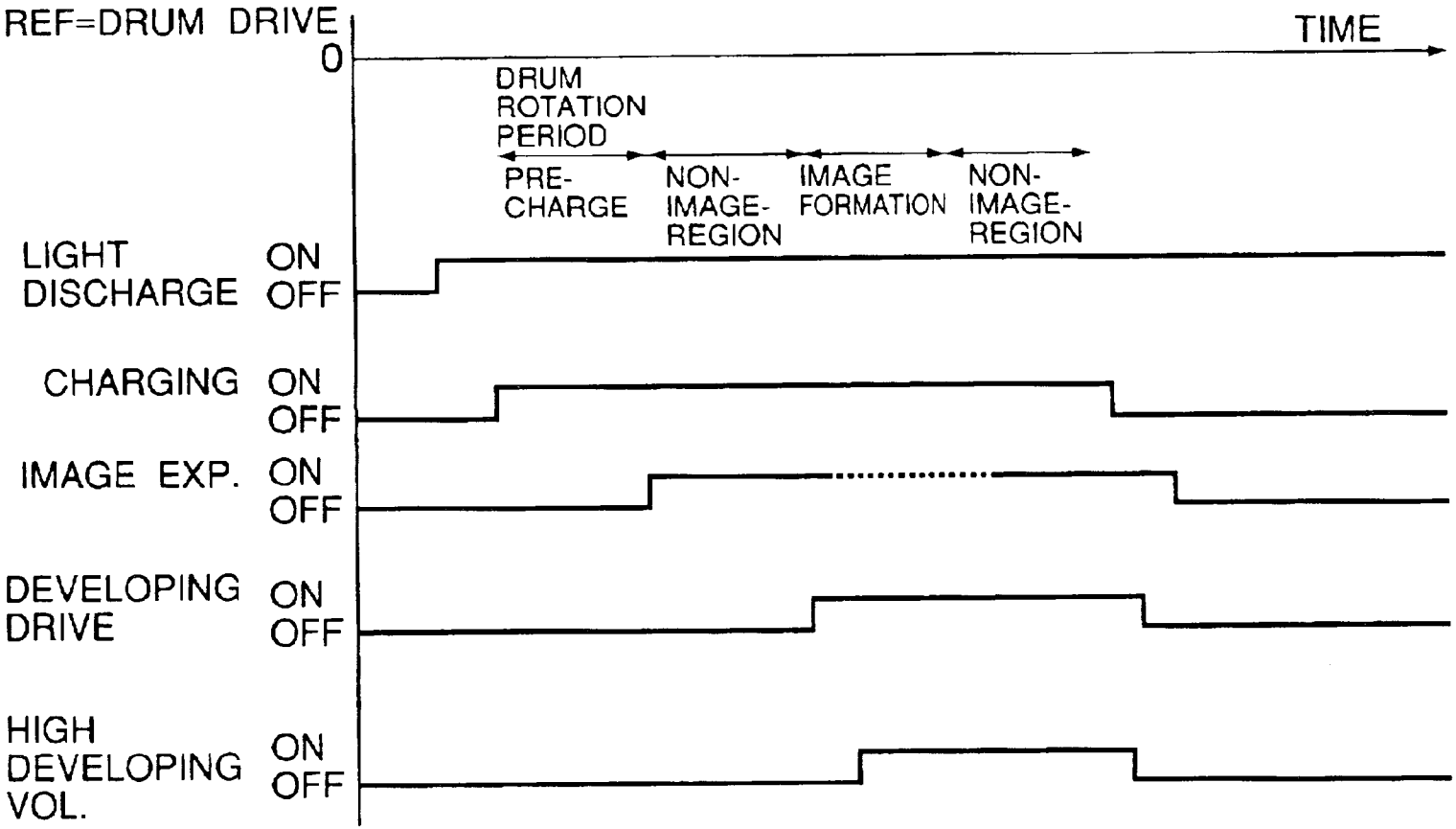
FIG. 4 is a drawing for depicting a charging method capable of properly charging a photoconductive member even in the initial stage of an image formation operation.
Figure 5:
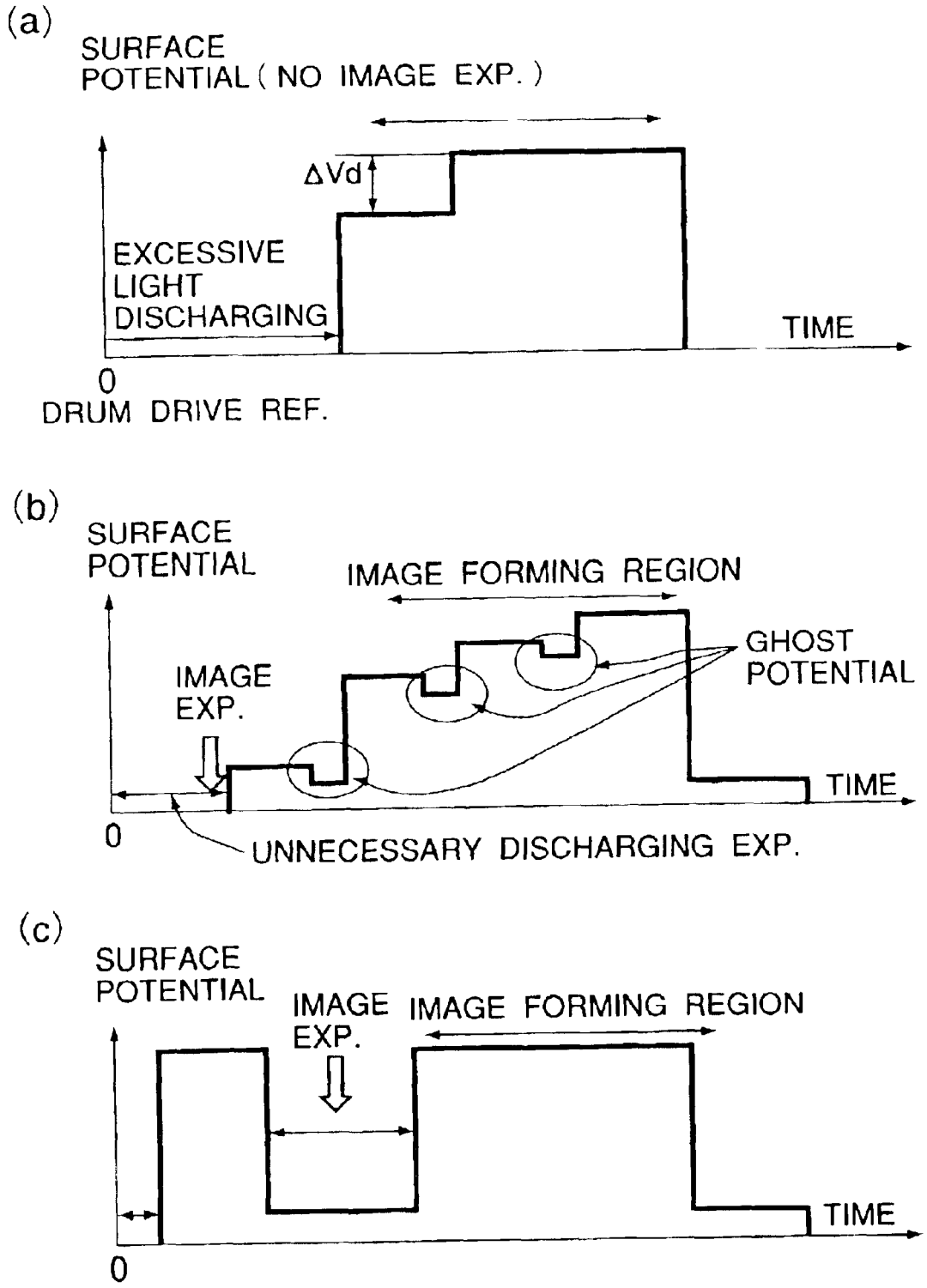
FIG. 5 is a drawing for depicting the change in the surface potential level of a photoconductive drum.
Figure 6:
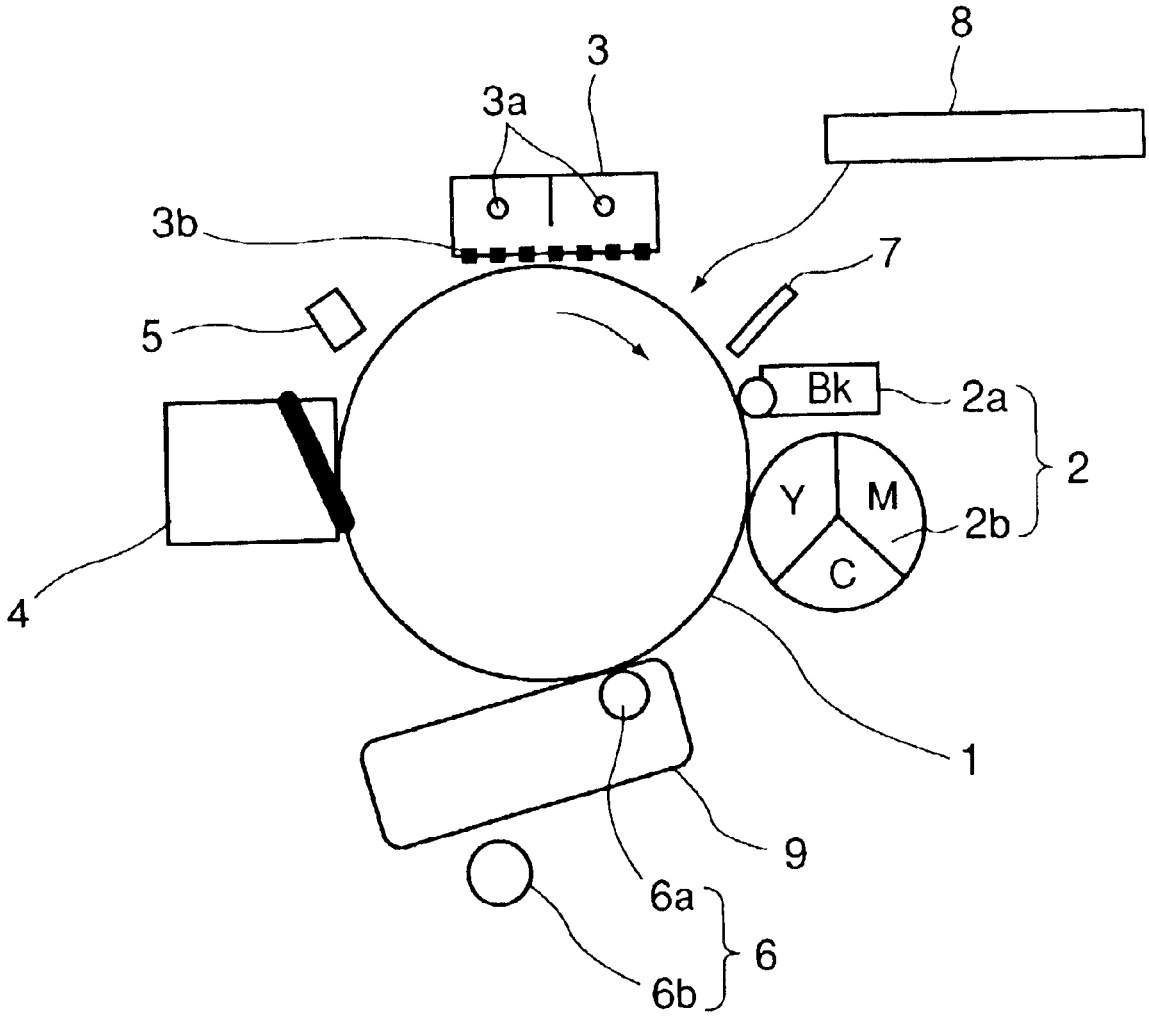
FIG. 6 is a schematic sectional view of an image forming apparatus having an intermediary transferring member.
Figure 7:
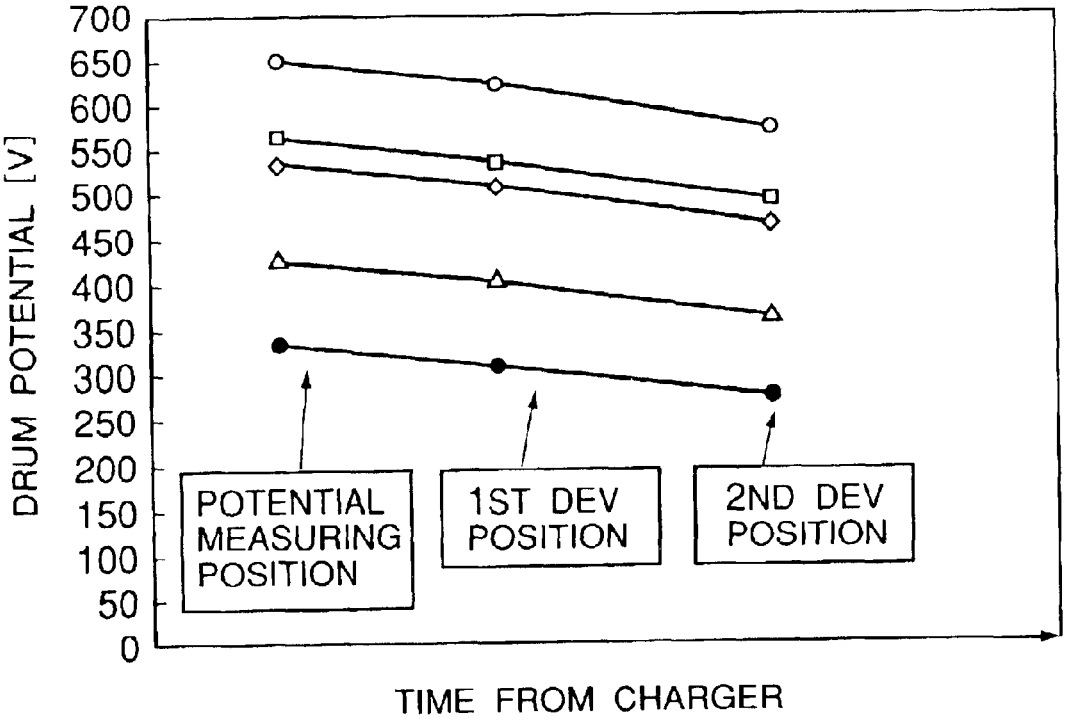
FIG. 7 is a graph for showing the difference in potential level among the different locations at which potential level was measured.
Figure 8:
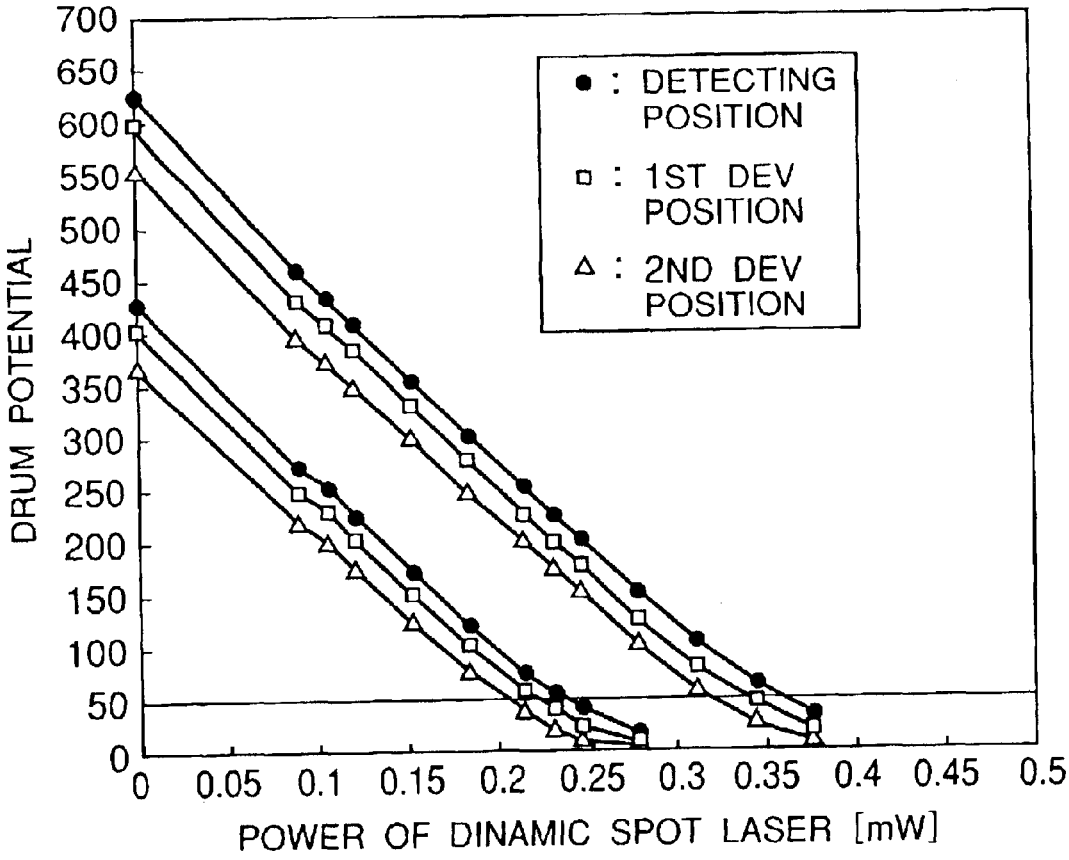
FIG. 8 is a graph for showing the relationship between the potential level at the peripheral surface of a photoconductive drum, and the amount of exposure light.
Figure 9:
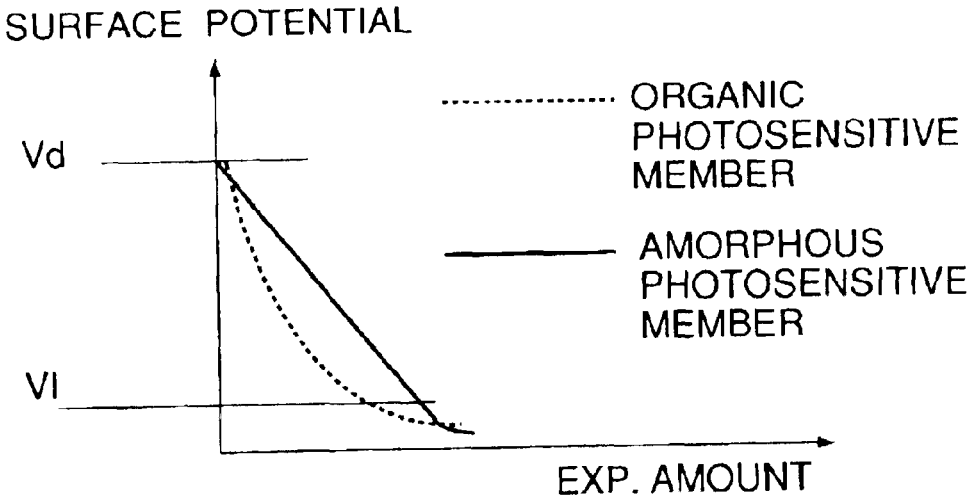
FIG. 9 is a drawing for showing the difference in E-V property between an organic photoconductive member and an amorphous photoconductive member.

Hereinafter, one of the preferred embodiments of the present invention will be described with reference to the appended drawings. FIG. 1 is a schematic sectional view of the image forming apparatus in this embodiment, and FIG. 2 is a drawing for depicting the structure of the photoconductive drum in this embodiment. FIG. 3 is a drawing for describing the ghost potential level (which is generated by the electrical charge hysteresis resulting from the nonuniformity in potential level which occurs within the aforementioned non-charged region). FIG. 4 is a drawing for depicting a charging method capable of stably charging a photoconductive drum even at the initial stage of an image forming operation. FIG. 5 is a drawing for depicting the potential level at the peripheral surface of a photoconductive drum. FIG. 6 is a schematic sectional view of an image forming apparatus having an intermediary transferring member. FIG. 7 is a graph for showing the difference in potential level among the different locations at which potential level was measured. FIG. 8 is a graph for showing the relationship between the potential level at the peripheral surface of a photoconductive drum, and the amount of exposure light. The descriptions of this embodiment given below with reference to an image forming apparatus are applicable to any apparatus among a copying machine, a printer, and a facsimile machine.

Referring to FIG. 1, the image forming apparatus is provided with a plurality of image forming means, which are disposed around an electrophotographic photoconductive member 1 as an image bearing member. More specifically, the image forming apparatus comprises: a charging device 3 as a charging means for charging the electrophotographic photoconductive member 1 for image formation; an exposing means 8 for exposing the peripheral surface of the photoconductive member 1 to exposure light modulated with the image formation data inputted for image formation; a potential level detecting means for detecting the potential level of the peripheral surface of the photoconductive drum 1; a developing device 2 as a developing means for normally developing an electrostatic latent image formed on the photoconductive drum 1; a transferring means 6 for transferring the image from the photoconductive drum 1 onto an intermediary transfer medium; a cleaning means 4 for cleaning the peripheral surface of the photoconductive drum 1 after the image transfer; and an optical charge removing means 5 for optically removing the electrical charge on the peripheral surface of the photoconductive drum 1 during the period between the completion of the transfer and the beginning of the following image forming rotational cycle of the photoconductive drum 1. These members and means are disposed around the electrophotographic photoconductive member, in the listed order in terms of the rotational direction of the photoconductive drum 1. Further, the developing device 2 has a first developing device 2*a* which develops the black (Bk) color component, and a second developing device 2*b* which develops yellow (Y), magenta (M), and cyan (C) color components.

The photoconductive drum 1 has an electrically conductive supporting member, and a photoconductive layer placed on the peripheral surface of the supporting member. The essential ingredient of the photoconductive layer is noncrystalline silicon. Thus, the photoconductive drum 1 is commonly called an amorphous photoconductive member.

Referring to FIG. 5, the photoconductive drum 1 has a laminar structure; five functional layers necessary for electrophotographic image formation are placed in layers on the electrically conductive supporting member. As for the primary material for the electrically conductive member, electrically conductive metallic substance, for example, aluminum, may be listed.

Also referring to FIG. 2, on the peripheral surface of the electrically conductive supporting member, a preventive layer for preventing electrical charge from being injected from the electrically conductive supporting member, a photoconductive layer in which charge couples generate as it is exposed to light; a charge transfer layer through which the generated electrical charge can move, and a charge retaining layer, or the outermost layer, for retaining the electrical charge, are layered in the listed order.

In order to adjust the spectroscopic sensitivity of the photoconductive layer, and to improve the electrical properties of the photoconductive member, the essential ingredient for the photoconductive layer, that is, silicon, may be impregnated with impurities such as hydrogen, oxygen, butane, and the like. As for the approximate thicknesses of the functional layers, that is, functional films, in the laminar structure formed on the peripheral surface of the electrically conductive supporting member, the preventive layer is 3 $\mu$m; the photoconductive layers (charge generation layer and charge transfer layer) are 30 $\mu$m; and the surface layer is 1

μm. A photoconductive member such as the photoconductive drum 1 described above is a preferable choice of a photoconductive member employed by the electrophotographic apparatus and image forming method in this embodiment, which will be described next.

In the image forming method in this embodiment, the charging process, exposing process, normal developing process (which is carried out at a plurality of locations), transferring process, and optical charge removing process, are carried out in the adjacencies of the photoconductive drum 1. Obviously, images can be formed using an ordinary image forming method. However, when forming images using an electrophotographic image forming apparatus, which will be described next, the employment of the image forming method in this embodiment yields preferable results.

As described above, the electrophotographic image forming apparatus in this embodiment comprises: the charging device 3 which charges the photoconductive drum 1; exposing means 8 which exposes the photoconductive drum; developing device 2 which carries out the normal development processes; transferring means 6 which carries out the intermediary transferring process; optical charge removing means 5 which optically removes electrical charge; and an unshown controlling means for controlling the operations of these devices and means.

As for the charging method employed by the charging device 3, there are two types: a contact charging method which employs an electrically conductive roller, an electrically conductive brush, or a magnetic brush; and a noncontact charging method such as a charging method employing a Scorotron. This embodiment will be described with reference to the charging method employing a Scorotron, or the most commonly employed charging method. However, the choice of the charging method does not need to be limited to the Scorotron based charging method; in other words, any charging method which is widely used in the fields of an image forming apparatus and an image forming method will suffice.

The charging device 3 is structured as shown in FIG. 1, comprising two discharge wires 3*a* (the number of the discharge wire may be one or three or more, although it is two in this embodiment), which are two pieces of tungsten wire, the diameter of which is in the range of 40–100 μm. Incidentally, they do not need to be formed of tungsten wire, as long as they are electrically conductive members in the form of a piece of wire, a needle-shaped electrode, a saw-toothed electrode, or the like, which is capable of releasing electrical discharge (members may be provided with an antioxidant surface layer). The voltage applied to the discharge wires 3*a* to trigger electrical discharge is 10 kV at the maximum, and a current of approximately 1,500 μA flows. The effective charging range of the charging device 3 means the range in which the peripheral surface of the photoconductive drum 1 is chargeable to a predetermined potential level by the charging device 3.

The grid 3*b* of the charging device 3 is formed of wire, the diameter of which is in the range of 50 μm–200 μm (formed of SUS304, SUS430, or other electrically conductive substance). However, a piece of electrically conductive metallic plate, through which a specific pattern, for example, a mesh pattern, has been cut by an edging process may be employed as the grid 3*b*. Through the above described charging process, the photoconductive drum 1 is charged by the charging device 3 to a potential level in the range of 200 V–1,000 V.

The exposing means 8 may be any exposing apparatus, which employs one of the known light sources, for example, a semiconductor laser, an LED, and the like; there is no specific restriction regarding the choice of the exposing means 8, as long as it is capable of exposing the peripheral surface of the photoconductive drum 1 to a beam of laser light, LED light, or the like, modulated with the image formation data of an intended image. Further, the exposing means 8 has only to be an optical device. In this embodiment, it exposes the portions of the peripheral surface of the photoconductive drum 1 corresponding to the non-image portions of an intended image. A latent image is formed by exposing means 8, which turns on or off a light emitting device which emits a beam of light, the diameter of which is equal to the smallest picture element which the image forming apparatus is capable of outputting. In other words, the latent image forming process carried out by the exposing means 8 is controlled by a so-called binary exposure controlling apparatus. The photoconductive drum exposing process is carried out by the exposing means 8, based on the image formation data from a reading apparatus which reads the image formation data of an original mounted in or on the image forming apparatus, or from an external apparatus (personal computer or the like) connected to the image forming apparatus.

The developing device 2 as a developing means uses a magnetic or nonmagnetic single-component developer, or a two-component developer. It normally develops a latent image by being placed in contact with the photoconductive drum, or without being placed in contact with the photoconductive drum. As for the type of developing device 2, any ordinary developing device or the like can be used. The choice of a developing device does not need to be limited to the one in this embodiment; it may be any ordinary device, as long as it is capable of developing a latent image on the peripheral surface of the photoconductive drum 1 with the use of charged toner, the polarity of which is opposite to the polarity to which the photoconductive drum 1 is charged.

The transferring means 6 is structured so that a plurality of toner images, which are different in color and are sequentially formed on the peripheral surface of the photoconductive drum 1 by developing device 2, are sequentially transferred (primary transfer) onto the intermediary transferring member, and then, all the toner images on the intermediary transferring member are transferred all at once (secondary transfer) onto recording medium. The choice of the transferring means 6 for transferring the toner images onto the intermediary transferring member, and also transferring the toner images onto recording medium, does not need to be limited to the transferring means 6 in this embodiment. In this embodiment, an electrically conductive elastic roller was employed as a transferring means, which comprised an electrically conductive rotational supporting portion, and an electrically conductive elastic layer formed on the peripheral surface of the supporting portion. In a charging operation, high voltage is applied to the electrically conductive supporting portion of the elastic roller, while keeping constant the voltage or the current flowed by the voltage; the high voltage applied to the electrically conductive supporting portion is controlled according to the ambience of the image forming apparatus, conditions of the toner images, and recording medium properties, so that toner images are satisfactorily transferred from the photoconductive drum 1 onto the intermediary transferring member, and then, from the intermediary transferring member onto recording medium.

The optical charge removing means 5 exposes the peripheral surface of the photoconductive drum 1 with the use of one of the known light sources. The choices of the exposing means and light source for the optical charging removing means 5 does not need to be limited to those in this embodiment. In the case of the image forming apparatus in this embodiment, however, it was desired, for the sake of image quality stability, that the peak wavelength λ1 of the light irradiated from the LED onto the photoconductive drum 1 to remove electrical charge from the photoconductive drum 1, and the peak wavelength λ2 of the light from the light source used for image exposure, satisfied the following relationship: $\lambda 1 \geqq \lambda 2$.

This is for the following reason: Referring to FIG. 3(*a*), using a light, the wavelength of which is longer than that of the light used for image formation exposure, as the electrical charge removing light, is more effective for erasing the hysteresis, or the optical memory generated in the photoconductive drum 1 by image formation exposure, than otherwise.

Referring to FIG. 3, the central wavelength of the exposing means 8 is 655 nm, whereas the central wavelength of the optical charge removing means is 660 nm. The reason for not setting the central wavelength of the optical charge removing means 5 to 700 nm, which is the most effective length of the three for reducing the ghost potential level, is that the greater the wavelength of light, the greater the distance the light penetrates into the photoconductive layer, and therefore, the greater the amount of charge couples generated in the photoconductive layer, which results in the greater drop in the potential level.

Further, even when the central wavelength of the optical charge removing means 5 is 660 nm, the hysteresis can be reduced to a level at which the image defects resulting from the hysteresis are virtually invisible, by reducing the ghost generating potential level deviation (drop) measured using the method shown in FIG. 3(*b*), to approximately 5 V.

An image forming operation using the image forming apparatus structured as described above is carried out in the following manner: First, the optical charge removing means 5 is activated immediately after the photoconductive drum 1 begins to be rotated. Then, as soon as the leading edge of the portion of the peripheral surface of the photoconductive drum 1, from which electrical charged has been removed by the optical charge removing means 5, reaches the location at which the leading edge opposes the charging device 3, the charging device 3 is made to start the charging operation.

Then, during the second rotation or thereafter, the exposing means 8 is made to start the charging operation as soon as the leading edge of the portion of the peripheral surface of the photoconductive drum 1, from which electrical charged has been removed by the optical charge removing means 5, reaches the location, at which the leading edge opposes the exposing means 8. The exposing means 8 exposes the image formation region to an optical image reflecting the image formation data, reducing the potential level of the areas of the image formation region corresponding to the background portion of the intended image, to a level at which toner does not adhere to the areas, while spanning a predetermined length of time. The above described operations may be controlled with the use of a known controlling means such as a computer. Obviously, they can be satisfactorily controlled with the use of the controlling means of the image forming apparatus in this embodiment.

Thereafter, development bias is applied to the developing device so that developer is adhered to the image portion of the electrostatic latent image on the photoconductive member, in other words, the electrostatic latent image is developed, as the electrostatic latent image opposes the developing device.

The image forming apparatus is equipped with a controlling means for carrying out the above described control sequences for controlling the optical charge removing means 5, charging device 3, exposing means 8, and developing device 2, following the above described sequence. More specifically, the image forming apparatus is equipped with a computer for controlling the operations of these means and devices with the timings represented by the timing charts in FIGS. 4 and 5. FIG. 5 does not show the operation in which the exposing means begins to irradiate light at its minimum level from the beginning of the rotation of the photoconductive drum 1.

When a charging method, shown in FIG. 4, for providing the peripheral surface of the photoconductive drum with stable electrical charge in terms of potential level is employed, the potential level of the photoconductive drum remains stable during latent image formation, as shown in FIG. 5.

In the case that the potential level of the photoconductive drum 1 is controlled based on the timing chart given in FIG. 4, the region of the peripheral surface of the photoconductive drum 1, the potential level of which is equal to the potential level (Vd) of the portion of the latent image, to which toner is to be adhered, passes the location at which the region opposes the developing device, during the first rotational cycle of the photoconductive drum 1. In order to prevent toner from being adhered across this region of the peripheral surface of the photoconductive drum 1 having been charged, while this region passes the location, at which the region opposes the developing device 2, the sleeve of the first developing device 2*a* is not rotated, and development bias, which is DC voltage, or a combination of DC voltage and AC voltage, or the like, is not applied, during the first rotational cycle of the photoconductive drum 1. Also during the first rotational cycle of the photoconductive drum 1, the second developing device 2*b* is kept retracted, by being pivotally moved about the axle by which the second device 2*b* is supported, away from the location, at which the second developing device 2*b* remains in contact with the photoconductive drum 1, and the development bias in the form of high voltage, for example, DC voltage, a combination of DC and AC voltage, or the like, is not applied.

Then, the developing device 2 is activated immediately after the leading edge of the region of the peripheral surface of the photoconductive drum 1, in which a latent image has been formed by the exposing means 8, in other words, the potential levels of the portions corresponding to the non-image portions (background portions) of the intended image have been reduced to the non-image potential level, by the exposing means 8 during the second rotational cycle of the photoconductive drum 1, passes the location at which the leading edge opposes the developing device 2, and then, the application of the development bias is started when the leading edge reaches the location at which it opposes the first developing device 2*a*. The second developing device 2*b* is returned to the location at which it opposes the photoconductive drum 1, and a development bias, which is a predetermined DC voltage, or a predetermined combination of DC and AC voltages, is applied to the second developing device 2*b*.

In this embodiment, the referential point on the peripheral surface of the photoconductive drum 1 to the beginning of the first rotational cycle of the photoconductive drum 1 in a given image forming operation is the center line of the region of the peripheral surface of the photoconductive drum 1, which is facing the optical charge removing means 5 when the image forming operation begins, which hereinafter will be referred to as the start line. The charging operation is started at the same time as the start line enters the location at which it opposes the charging device 3. Then, after the start line is orbitally moved about the axial line of the photoconductive drum 1 a distance equivalent to no less than one full orbiting while the photoconductive drum 1 is charged by the charging device 3, the process for forming a latent image is started; in other words, the potential levels of the portions of the charged region of the peripheral surface of the photoconductive drum 1 corresponding to the non-image portions of the intended image begin to be reduced to the non-image level, by the exposing means 8. This operation includes the operation in which the exposing means 8 begins to emit light at its lowest level, and which is started at the same time as the photoconductive drum 1 begins to be rotated.

More specifically, the charging operation by the charging device 3 is started at approximately the same time as the aforementioned start line, or the leading edge of the region from which electrical charge has been removed by the optical charge removing means, reaches the downstream end of the effective charging range of the charging device 3, in terms of the rotational direction of the photoconductive drum 1.

Incidentally, the present invention encompasses a case in which, due to the variation in the time necessary for starting up the electrical power source for applying charge bias to the charging device 3 and/or various errors, the time when the start line, or the leading edge of the region cleared of electrical charge by the optical charge removing means, reaches the downstream end of the effective charging range of the charging device 3, does not coincide with the time when the charging operation by the charging device 3 is started.

An image forming method employing a normal developing method in accordance with the prior arts has been employed in an analog copying machine. In the case of this image forming method, in order to effect the non-image potential level immediately after the photoconductive drum 1 is charged, an image forming apparatus comprises a so-called blank lamp, which is a light source for projecting light across the region of the peripheral surface of the photoconductive drum 1 corresponding to the non-image portion of the intended image, and which is independent from the light sources for exposure and charge removal. Further, in the case of an image forming apparatus, in which the potential level of the portion of the peripheral surface of the photoconductive drum 1 corresponding to the non-image portion of the intended image, and the potential level of the portion of the peripheral surface of the photoconductive drum 1 corresponding to the image portion of the intended image, are both effected by the same exposing means, a potential level controlling means comparable to the potential level controlling means employed by an analog copying method is employed to reduce the potential level of the region of the peripheral surface of the photoconductive drum 1 corresponding to the non-image portion of the intended image, to the potential level corresponding to the non-image region of the intended image.

In this method, during the initial stage of the photoconductive drum rotation, the charging operation is not carried out, and only the optical charging means is activated. In other words, until the rotation of the photoconductive drum stabilizes, that is, while the rotation of the motor for rotationally driving the photoconductive drum becomes stable (generally, 100 msec–300 msec) and the image formation data of an intended image are processed for exposure, by the image forming apparatus, the charging means is not operated. Then, after excessively exposing of the photoconductive drum to charging removing light, the operation of the charging means is started, and then, the charged region of the peripheral surface of the photoconductive drum 1 is exposed by the exposing means to reduce the potential levels of the portions of the charged region corresponding to the non-image portions of the intended image to the non-image potential level. As a result, the potential level of a given region of the peripheral surface of the photoconductive drum 1 during the second rotational cycle and thereafter becomes different from the potential level of the same region of the peripheral surface of the photoconductive drum 1 during the first rotational cycle of the photoconductive drum 1, as shown in FIGS. 5(*a*) and 5(*b*). FIG. 5(*a*) represents the changes in the potential level of a given region of the peripheral surface of the photoconductive drum 1 which occurs as the electrical charge of the given region is optically removed before the starting of the operation of the charging device 3, whereas FIG. 5(*b*) represents that which occurs as the potential level of the given region is reduced by the exposing means to the level corresponding to the non-image portion of an intended image, immediately before the starting of the operation of the charging device 3.

The image forming apparatus and image forming method in this embodiment are capable of satisfactorily forming an image even during the initial stage of an image forming operation, regardless of the above described circumstance. FIG. 5(*c*) is a drawing for depicting the control, in this embodiment, for charging the photoconductive drum 1 during the startup period.

Referring to FIG. 5(*c*), the length of time necessary for the driving system to become stabilized (the length of time between when the rotation of the photoconductive drum 1 begins, and the time when the peripheral velocity of the photoconductive drum 1 becomes stabilized) is normally 100–300 msec, and the photoconductive drum 1 in this embodiment, which is 80 mm in diameter, rotates at a high speed, more specifically, a peripheral velocity of no less than 265 mm/sec. Therefore, the rotation of the photoconductive drum 1 becomes stabilized before the first rotational cycle of the photoconductive drum 1 ends.

During the first rotational cycle of the photoconductive drum 1, as a given region of the peripheral surface of the photoconductive drum 1 enters the range in which it opposes the optical charge removing means, it is exposed to the charge removing light. Then, as it enters the range in which it opposes the charging device 3, it is charged by the charging device 3. Then, it is recharged after the completion of the first rotational cycle of the photoconductive drum 1. During this period between the first charging and recharging of the region, even if the driving system is slightly unstable, it does not create any problem in practical terms, for the following reason: During the initial stage of an image forming operation, it is unnecessary to carry out the operation for optically erasing the hysteresis. Thus, by not exposing a given region of the peripheral surface of the photoconductive drum 1 to the charge removing light for a duration equivalent to several rotational cycles of the photoconductive drum 1, it is possible to reduce the length of time necessary to output the first copy after the starting of an image forming operation, that is, the so-called first print time (the length of time from when an image formation start signal is inputted to when the first recording medium bearing an image is discharged from the main assembly of an image forming apparatus), and by not exposing the given region to the exposing light in the range between the non-charging range and the range in which the given portion is charged by the charging device 3 during the first rotational cycle of the photoconductive drum 1, it is possible to prevent unnecessary memories from being created by the exposure light.

Further, the usage of the above described controlling method for reducing the potential level of a given region of the peripheral surface of the photoconductive drum 1 to a level corresponding to the non-image area of an image before charging the given region to expose the given region to the optical image of an intended image, does not need to be limited to when the corona discharge type charging device in this embodiment of the present invention is used; this controlling method is also effectively used in conjunction with a contact charging method employing a charge roller, and an injection charging method employing a magnetic brush.

During the initial stage of an image forming operation, in which the driving system is unstable, it is necessary to adjust the timings with which voltage is applied to the optical charge removing means, exposing means 8, and charging device 3, which act on the photoconductive drum 1. However, the adjustment of the above described timing can be avoided by adjusting, for compensating for the above described timing deviation, the set of controlling means for controlling the aforementioned plurality of image forming processes carried out within an image forming apparatus.

Next, a method for satisfactorily effecting the latent image potential level, without changing the operational conditions for the charging device 3, using an image forming apparatus comprising an intermediary transferring member, and a plurality of developing devices 2 disposed at the locations where they oppose the photoconductive drum 1, will be described.

Referring to FIG. 6, which is a schematic sectional view of the image forming apparatus, the image forming apparatus in FIG. 6 comprises an amorphous photoconductive drum 1, a charging device 3, an image forming exposing means 8, a potential level detecting means 7, a developing device 2 (which comprises: a first developing device 2*a* fixed to the interior of the image forming apparatus; and a plurality of second developing devices 2*b* which are attached to a rotary and are located on the downstream side of the first developing device 2*a*), an intermediary transferring member 9, a first transferring means 6*a* for transferring a toner image onto the intermediary transferring member 9, and a second transferring means 6*b* for transferring the toner image onto recording medium. These devices and means are disposed around the amorphous photoconductive drum 1.

In the image forming apparatus shown in FIG. 6, a toner image of a first color is formed on the peripheral surface of the photoconductive drum 1 using the above described charging method which prevents the potential level deviation during the initial stage of photoconductive drum rotation, and also, does not generate a ghost, and then, the formed toner image is transferred onto the intermediary transferring member 9. Any developing device among the first developing device 2*a* and second developing devices 2*b*, which are different in the color component they develop, may be used to carry out the image forming operation for the first color component. Further, the toner image corresponding to the first developing device 2*a* may be formed while a plurality of toner images different in color are sequentially formed on the photoconductive drum 1 by the second developing devices 2*b* mounted in the rotary.

In the following description of the image forming apparatus, it will be assumed for the sake of convenience that the color component developed by the first developing device 2*a* is black Bk, and the rest of the color components developed by the second developing devices 2*b* is yellow Y, magenta M, and cyan C.

As for the developing method employed by the developing device 2, when the photoconductive drum 1 is charged to positive polarity, the normal development process is carried out with the use of negatively chargeable toner. The polarity to which the photoconductive drum 1 is charged, and the polarity to which the toner used by the developing means is charged, may be reversed. However, when employing a corona type charging device as a charging means, the polarities to which the photoconductive drum 1 and toner are charged should be the same as those to which they are charged in this embodiment, so that the amount by which ozone is generated by the charging device is minimized.

One of the essential objects of the present invention is to enable an image forming apparatus to form images without losing the image output speed, regardless of the length of an image formed on the intermediary transferring member 9 and the number of images. However, the image forming operation may be carried out under the condition that the image forming apparatus is allowed to idle during the image formation intervals, and also the number of the images formed on the intermediary transferring member 9 is allowed to be reduced.

Next, the method for measuring the relationship between the potential level stored in the image forming apparatus, and the amount of exposure light, the manner in which they are stored, and the compensating method, will be described.

After providing the photoconductive drum 1 with a predetermined potential level using the above described charging method, the exposure light is repeatedly turned on and off by the exposing means during each rotational cycle of the photoconductive drum 1 while changing, in steps, the amount of the exposure light, and detecting the resultant potential level. The relationship between the amount of the exposure light and the resultant potential level in each step is stored in a storage means such as a ROM. As for the direction in which the amount of the exposure light is changed in steps, the amount of the exposure light may be changed in the increasing direction or decreasing direction. With the use of this method, the relation between the potential level of the region of the peripheral surface of the photoconductive drum 1 in the range in which the region opposes the potential level detecting means and the amount of the exposure light is determined. The factors controlled for correcting the relationship between the potential level to which the photoconductive drum 1 is charged with a predetermined timing, and the amount of the exposure light, includes: the control timing which is set according to the output count, which is automatically set, or can be optionally set, as the main switch of an image forming apparatus is turned on; and the video count of the image formation data used for exposure. Incidentally, the "dark attenuation" of a photoconductive drum means that the surface potential level of a charged photoconductive drum attenuates due to the injection carrier, thermal excitation carrier, and the like. The information regarding the dark attenuation of the photoconductive drum is stored within the image forming apparatus.

When a photoconductive member is replaced, the dark attenuation data of the old photoconductive member stored in the backup data storage of the image forming apparatus main assembly can be easily rewritten internally, based on the detected data of the new photoconductive member, through the control panel of the image forming apparatus, or can be externally rewritten through a communicating means, when the image forming apparatus is provided with a communicating means.

Further, the image forming apparatus has a plurality of developing devices 2 different in location. Therefore, the potential levels detected by the potential level detecting means 7 alone are not sufficient for satisfactory correction. Thus, the correction is made according to the data regarding the potential level attenuation, obtained at the plurality of the development positions corresponding to the plurality of developing devices 2.

During the testing process carried out at the time of shipment, that is, before the mounting of the photoconductive drum 1 into the apparatus main assembly, the photoconductive drum 1 employed by the image forming apparatus is measured in the amount by which the potential level of a given region of the peripheral surface of the photoconductive drum 1, drops as the given region moves to the exposure position and development position. The data obtained by the above described measurement are stored in advance in the image forming apparatus.

Based on these data and the relationship between the potential level and the amount of exposure light, the amount by which the exposure light is irradiated by the exposing means is corrected to obtain the proper amount of exposure light for each developing position.

FIG. 7 offers the data regarding the electrical charge attenuation which occurs while the given region moves to the location of the first developing device 2*a*, and the location of the rotary, which is fixed to the apparatus main assembly and is holding a plurality of developing means (second developing devices 2*b*). In the drawing, the position of the potential level detecting means 7 is where the potential level is measured; the position of the first developing device 2*a* is the first development position; and the position of the second developing device 2*b* is the second development position.

It is evident from FIG. 7 that in terms of the amount by which the potential level of a given region of the peripheral surface of the photoconductive drum 1 drops while the given region moves from the potential level measurement point to the first or second development positions, there is little difference among the potential levels to which the given region is charged. It should be noted here, however, that what is offered in the drawing are the results obtained under the condition that the given region was charged to a potential level high enough for the potential level of the given region at the second development point to be high enough for the second developing device 2*b*; in the case of the amorphous photoconductive drum 1 employed by the image forming apparatus in this embodiment, the potential level of the second developing device 2*b* is no more than 600 V.

Next, the E-V property of the photoconductive drum 1 was studied by measuring the potential level of a given region of the peripheral surface of the photoconductive drum 1 at each of the positions of the first and second developing devices 2*a* and 2*b*, while changing the charging condition of the charging device 3 and the exposing condition of the exposing means 8.

As is evident from FIG. 8, in the range in which the potential level of the exposed portion was no less than 50 V, and the E-V property was linear, there was little difference among the E-V properties at the aforementioned three positions; the difference in potential level among the three measurement positions remains approximately constant, at the amount proportional to the amount of exposure light. It should be noted here, however, that, in order for the relationship in potential level among the three measurement positions shown in FIG. 8 to hold, the amount of the exposure light irradiated by the optical charge removing means 5 must remain constant, and also, the temperature of the photoconductive drum 1 must remain constant.

In the image forming apparatus in this embodiment, a heater for controlling the temperature of the photoconductive drum 1 is disposed within the hollow of the cylindrical base of the photoconductive drum 1 to keep constant the temperature of the photoconductive drum 1. This is why the relationships shown in FIGS. 7 and 8 held.

The method for controlling the potential level, to which a given region of the peripheral surface of the photoconductive drum 1 settles, will be described in more detail. As is evident from FIG. 8, regardless of the potential level to which the photoconductive drum 1 is charged, the differences in potential level of the given region, among the positions of the potential level measuring means, first developing device 2*a*, and the second developing device 2*b*, remain constant at the amount proportional to the amount of the exposure light irradiated by the exposing means 8.

The color of the first toner image formed in an operation for forming a full-color image may be any of the aforementioned four colors; it does not matter which of the plurality of developing devices 2 are used to form the first toner image. First, the amount by which the amount of the exposure light for the first color is adjusted, based on the difference between a potential level V1 (potential level corresponding to maximum exposure) detected at the potential level measurement point, and a target potential level. Assuming that the deviation of the potential level to the potential level VI occurs due to the deviation of the amount of the exposure light, the correction amount correspondent to the difference between the potential level VI and the target potential level, in other words, the amount by which the amount of the exposure light is to be adjusted, is stored.

Next, while the second toner image and thereafter are formed using the first developing device 2*a* or one of the plurality of second developing devices 2*b*, the potential levels Vd and VI are both controlled by adding the above described adjustment amount to the target amount of the exposure light calculated based on the data regarding the relationships, shown in FIG. 8, between the amount of the exposure and the potential level of a given region of the peripheral surface of the photoconductive drum 1, at the positions of the potential level detecting means 7, and first and second developing devices 2*a* and 2*b*, stored in a table form within the image forming apparatus.

This control method is characterized in that it takes advantage of the fact that as long as the E-V property of the amorphous photoconductive drum 1 and the temperature of the photoconductive drum 1 are kept stable, the chargeability and sensitivity of the photoconductive drum 1 remains stable.

In this embodiment, the difference between the potential level to which a given region of the peripheral surface of the photoconductive drum 1 was charged and the potential level of the same region at the time of its exposure, was studied by using the photoconductive drum 1, the main ingredient of which was noncrystalline silicon (amorphous silicon), in combination with an electrophotographic image forming method, in which a latent image was formed by the BAE method, and was normally developed. As a result, it was discovered that how the image forming apparatus was started up was very important.

More specifically, in the image forming process, before a given region of the peripheral surface of the amorphous photoconductive drum was charged, it was not exposed to an excessive amount of charge removing light, in the non-charging range, that is, the range on the upstream side of the charging range; in other words, it was not exposed wastefully. Also in the image forming process, during the first rotational cycle of the photoconductive drum 1, the process for effecting, by the exposing means, non-image potential level necessary for normally developing a latent image formed by the BAE method was not carried out. As a result, the time it takes for the given region of the peripheral surface of the photoconductive drum 1 to be wastefully moved through the charge removing range was eliminated. Therefore, the first print time was reduced, and also, generation of unnecessary electrical charge in the charge generation portion of the photoconductive drum 1 was prevented, preventing thereby memories from being generated by the exposure light.

Further, in order to prevent toner from being adhered to the regions of the peripheral surface of the photoconductive drum 1, the potential level of which was the same as the potential levels of the areas of the latent image, to which toner was to be adhered, while the region was moved through the developing range, the biases to be applied to the developing devices 2 were adjusted so that toner was not adhered to the above described region, or the developing devices 2 were moved out of the position at which they opposed the photoconductive drum 1.

It was discovered that with the use of the above described methods, it was possible to stabilize the initial stage of an image forming process carried out by the image forming apparatus, preventing thereby the density deviation traceable to the changes in the potential level of a given region of the peripheral surface of the photoconductive drum 1 from the potential level (Vd) to which the given region is to be initially charged, and that the amount of the image memory traceable to exposure could be reduced by not exposing the photoconductive drum 1 by the exposing means 8 during the non-charging period, that is, the initial stage of the rotation of the photoconductive drum 1.

In an image forming operation carried out by the image forming apparatus in this embodiment, first, a toner image corresponding to the first color component of an intended image was formed on the photoconductive drum 1 while using a controlling means for controlling the potential level to which the photoconductive drum 1 was charged in the initial stage of the image forming operation. Then, the toner image was transferred onto the intermediary transferring member 9. Then, the toner images corresponding to the second color component and thereafter were sequentially formed on the photoconductive drum 1, and were sequentially transferred onto the intermediary transferring member 9 in layers. After all the toner images were transferred onto the intermediary transferring member 9 in layers, they were transferred all at once onto recording medium.

The potential level of the latent image for one color component is different from the potential levels of the latent images for other color components. Thus, the target potential level for each color component was stored in the image forming apparatus main assembly, and when switching the developing means, the latent image contrasts for the second color component and thereafter were corrected by correcting the amount of exposure light, based on the above described factors, and the stored target potential levels.

In this controlling method, the compensatory amount of exposure light necessary to realize the target potential level for each of the second color components and thereafter was calculated, based on the non-image area potential level detected before the photoconductive drum was charged to form the latent image for the first color component during the initial stage of an image forming operation, the amount of exposure light, the dark attenuation data stored within the apparatus main assembly, and the E-V property measured with a predetermined timing. The obtained data were transmitted to the controlling means to control the potential level in the image formation range.

Therefore, it was possible make the potential level of the exposed portion settle to a value suitable for the image formation condition, while sequentially forming the plurality of toner images different in color, reducing the amount of the time required for potential level control, eliminating the idling time for the intermediary transferring member 9, which reduced the output count. As a result, it was possible to provide an image forming apparatus and an image forming method, which were very short in first print time, and capable of forming high quality images.

As described above, according to this embodiment, it is possible to easily and quickly form full-color images of high quality, that is, images suffering from no ghosts traceable to potential level deviation. Further, it is possible to easily and instantly adjust the latent image potential level to an optimal level for each color component, even when images are formed by an image forming apparatus employing an intermediary transferring member, with its output set at the maximum.

(Miscellanies)

In the above described embodiment, the present invention was described with reference to the full-color image forming apparatus equipped with the developing device 2 comprising the first and second developing devices 2*a* and 2*b*. However, the application of the present invention does not need to be limited to such an apparatus; the present invention is also applicable to a monochromatic image forming apparatus.

While the invention has been described with reference to the structures disclosed herein, it is not confined to the details set forth, and this application is intended to cover such modifications or changes as may come within the purposes of the improvements or the scope of the following claims.

What is claimed is:

1. An image forming apparatus comprising:

a rotatable image bearing member;

charging means for electrically charging said rotatable image bearing member;

image forming means for forming an image on said rotatable image bearing member charged by said charging means;

optical discharging means for electrically discharging said rotatable image bearing member, wherein, after start of rotation of said rotatable image bearing member, a discharging operation of said optical discharging means is started, and a charging operation of said charging means is started such that a leading edge of a discharged area provided by said optical discharging means is substantially aligned with a charging starting position by said charging means.

2. An image forming apparatus according to claim 1, wherein the charging operation of said charging means is started when the leading end of the area discharged by said optical discharging means reaches a downstream end of an effective charging region with respect to a rotation direction of said rotatable image bearing member.

3. An image forming apparatus according to claim 1 or 2, wherein said image forming means includes image exposure means for exposing said rotatable image bearing member charged by said charging means on the basis of image information, wherein said image exposure means starts its exposure operation when a the leading end of the area discharged by said optical discharge means substantially reaches a charging position of said charging means.

4. An image forming apparatus according to claim 3, wherein said image forming means includes developing means for regular development of a latent image formed on said rotatable image bearing member with a developer.

5. An image forming apparatus according to claim 4, wherein a non-image-portion potential is provided using said image exposure means prior to formation of an electrostatic image on said rotatable image bearing member on the basis of image information.

6. An image forming apparatus according to claim 5, wherein said rotatable image bearing member includes a photosensitive layer comprising amorphous silicon as a major component.

7. An image forming apparatus according to claim 3, wherein a peak wavelength $\lambda 1$ of a light source of said optical discharging means and a peak wavelength $\lambda 2$ of a light source of said image exposure means, satisfies $\lambda 1 \geqq \lambda 2$.

8. An image forming apparatus according to claim 1, wherein said rotatable image bearing member is rotatable along an endless path.

* * * * *

UNITED STATES PATENT AND TRADEMARK OFFICE

CERTIFICATE OF CORRECTION

PATENT NO. : 6,826,375 B2
DATED : November 30, 2004
INVENTOR(S) : Ken-Ichiro Kitajima It is certified that error appears in the above-identified patent and that said Letters Patent is hereby corrected as shown below:

Title page,
Item [56], References Cited, FOREIGN PATENT DOCUMENTS, "01291269 A" should read -- 01-291269 A --; and 2000147967 A" should read -- 2000-147967 A --.

Drawings,
Figure 2, "TRASPORTATION" should read -- TRANSPORTATION --; "ELCTROCONDUCTIVE" should read -- ELECTROCONDUCTIVE --; and "(e.g.A*l*)" should read -- (e.g., A*l*) --.
Figure 8, "DINAMIC" should read -- DYNAMIC --.

Column 1,
Line 60, "members" should read -- member --.

Column 3,
Line 3, "negatively" should read -- negative --.

Column 9,
Line 40, "charged" should read -- charge --.

Column 10,
Line 48, "charged" should read -- charge --.

Column 19,
Line 1, "a" should be deleted.

Signed and Sealed this

Tenth Day of May, 2005

JON W. DUDAS
*Director of the United States Patent and Trademark Office*